US009636567B2

(12) United States Patent
Brammer et al.

(10) Patent No.: US 9,636,567 B2
(45) Date of Patent: May 2, 2017

(54) EXERCISE SYSTEM WITH DISPLAY PROGRAMMING

(75) Inventors: Chase Brammer, Providence, UT (US); Richard K. C. Chang, II, Mendon, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 751 days.

(21) Appl. No.: 13/467,794

(22) Filed: May 9, 2012

(65) Prior Publication Data

US 2012/0295764 A1 Nov. 22, 2012

Related U.S. Application Data

(60) Provisional application No. 61/488,637, filed on May 20, 2011.

(51) Int. Cl.
*A63B 22/00* (2006.01)
*A63B 22/02* (2006.01)
(Continued)

(52) U.S. Cl.
CPC ..... *A63B 71/0622* (2013.01); *A63B 22/02* (2013.01); *A63B 22/025* (2015.10); *A63B 22/0242* (2013.01); *A63B 24/0062* (2013.01); *A63B 24/0087* (2013.01); *A63B 22/0023* (2013.01); *A63B 2024/0068* (2013.01); *A63B 2071/0638* (2013.01); *A63B 2071/0644* (2013.01); *A63B 2220/12* (2013.01); *A63B 2220/17* (2013.01); *A63B 2220/18* (2013.01); *A63B 2220/30* (2013.01);
(Continued)

(58) Field of Classification Search
CPC .... A63B 2071/0638; A63B 2071/0641; A63B 2071/0644; A63B 2071/0096; Y10S 482/901
USPC ..... 482/8, 4, 902, 7, 900, 901
See application file for complete search history.

(56) References Cited

U.S. PATENT DOCUMENTS 4,298,893 A * 11/1981 Holmes ..... H04N 5/63 248/917
4,637,605 A * 1/1987 Ritchie ..... A63B 71/0622 273/148 B
(Continued)

FOREIGN PATENT DOCUMENTS

WO W097/41925 11/1997

OTHER PUBLICATIONS

International Search Report, PCT/US2012/037247, Jul. 26, 2012.
(Continued)

*Primary Examiner* — Sundhara Ganesan
*Assistant Examiner* — Jennifer M Deichl
(74) *Attorney, Agent, or Firm* — Maschoff Brennan

(57) ABSTRACT

An exercise system presents display programming at a rate that is commensurate to a user's exercise rate. The user's exercise rate is monitored and compared to a default exercise rate. When the user's exercise rate is above or below the default exercise rate, the presentation of the display programming is adjusted to maintain a temporal relationship between the user's exercise rate and the display programming. The presentation of the display programming can be adjusted by periodically skipping or pausing frames of the display programming to increase or decrease the duration of the display programming.

15 Claims, 8 Drawing Sheets

(51) Int. Cl.
*A63B 24/00* (2006.01)
*A63B 71/06* (2006.01)

(52) U.S. Cl.
CPC ..... *A63B 2220/40* (2013.01); *A63B 2220/73* (2013.01); *A63B 2220/806* (2013.01); *A63B 2220/89* (2013.01); *A63B 2225/20* (2013.01); *A63B 2230/06* (2013.01)

(56) References Cited

U.S. PATENT DOCUMENTS 5,142,358 A * 8/1992 Jason ..... A63B 71/0622 348/552
5,246,411 A * 9/1993 Rackman ..... A63B 71/0622 348/552
5,779,596 A * 7/1998 Weber ..... A61B 5/222 482/4
6,142,913 A * 11/2000 Ewert ..... A63B 24/00 386/E5.002
6,152,856 A 11/2000 Studor et al.
6,179,746 B1 * 1/2001 Delman ..... A63B 71/0622 482/2
6,287,239 B1 9/2001 Hernandez
6,312,363 B1 11/2001 Watterson et al.
6,336,891 B1 * 1/2002 Fedrigon ..... A63B 22/02 434/247
6,458,060 B1 10/2002 Watterson et al.
6,997,852 B2 2/2006 Watterson et al.
7,044,891 B1 * 5/2006 Rivera ..... A63B 21/0053 482/1
7,060,006 B1 6/2006 Watterson et al.
2004/0127334 A1 * 7/2004 Heppert ..... A63B 21/0053 482/2
2005/0075213 A1 4/2005 Arick
2005/0239601 A1 * 10/2005 Thomas ..... A63B 24/00 482/1
2006/0122035 A1 6/2006 Felix
2007/0265138 A1 11/2007 Ashby
2009/0209393 A1 8/2009 Crater et al.

OTHER PUBLICATIONS

International Preliminary Report on Patentability, PCT/US2012/037247, Nov. 20, 2013.
European Search Report issued for 12788826.1 on Sep. 2, 2015.

* cited by examiner

EXERCISE SYSTEM WITH DISPLAY PROGRAMMING

CROSS-REFERENCE TO RELATED APPLICATIONS

This application claims priority to and the benefit of U.S. Provisional Patent Application No. 61/488,637, filed on May 20, 2011, and entitled EXERCISE SYSTEM WITH DISPLAY PROGRAMMING, which is incorporated herein by reference in its entirety.

TECHNICAL FIELD

This invention relates generally to systems, methods, and devices for exercise. More particularly, the invention relates to systems and methods that correlate the playback of a video or images with a user's rate of exercise.

BACKGROUND

One common challenge with exercise equipment is motivating the user to use the exercise equipment on a consistent and ongoing basis. This lack of motivation can be a result of the repetitive nature of the exercises and exercise routines that a user can perform on a specific exercise device and the lack of intellectual stimulation or entertainment available during use of the exercise equipment.

In order to combat this lack of stimulation, many exercise devices are equipped with a display that depicts a track indicating progress or a hill profile representing the difficultly level of the exercise routine. Still other exercise systems, such as the system described in U.S. Pat. No. 6,142,913 to Ewert, attempt to correlate the playback of a video to the rate of exercise. For instance, the system described in Ewert monitors the level of activity on an exercise device and adjusts the video frame rate accordingly. To adjust the video frame rate, the Ewert system modifies the duration time stamp on each video frame to change the sequential time at which each frame is displayed. In addition, other exercise devices include those in U.S. Pat. Nos. 6,152,856, 6,287,239, 6,312,363, 6,458,060, 6,997,852, 7,060,006, U.S. Patent Publication No. 2006/0122035, U.S. Patent Publication No. 2007/0265138, and U.S. Patent Publication No. 2009/0209393.

SUMMARY OF THE INVENTION

In one aspect of the disclosure, an exercise system includes a movable element and a display.

In another aspect that may be combined with any of the aspects herein, the movable element is movable in the performance of an exercise.

In another aspect that may be combined with any of the aspects herein, the movable element has at least one selectively adjustable operating parameter that selectively alters an exercise rate of a user relative to a default exercise rate.

In another aspect that may be combined with any of the aspects herein, the display presents display programming to the user.

In another aspect that may be combined with any of the aspects herein, the display programming includes one or more frames.

In another aspect that may be combined with any of the aspects herein, the presentation of the display programming is adjustable to correlate the presentation of the display programming with the exercise rate of the user.

In another aspect that may be combined with any of the aspects herein, the presentation of the display programming is adjusted by periodically pausing the display programming.

In another aspect that may be combined with any of the aspects herein, the display programming has a default display rate.

In another aspect that may be combined with any of the aspects herein, the exercise system has a default exercise rate that corresponds to the default display rate of the display programming.

In another aspect that may be combined with any of the aspects herein, the presentation of the display programming is adjusted an amount that is commensurate with the difference between the exercise rate of the user and the default exercise rate.

In another aspect that may be combined with any of the aspects herein, the presentation of the display programming is adjusted by pausing the display programming at regular intervals when the exercise rate of the user is less than the default exercise rate.

In another aspect that may be combined with any of the aspects herein, the duration of the periodic pauses in the display programming are substantially equal to one another.

In another aspect that may be combined with any of the aspects herein, the presentation of the display programming is adjusted by pausing the display programming at irregular intervals when the exercise rate of the user is less than the default exercise rate.

In another aspect that may be combined with any of the aspects herein, the duration of the periodic pauses in the display programming are not all equal to one another.

In another aspect that may be combined with any of the aspects herein, periodically pausing the display programming increases the duration of display programming.

In another aspect that may be combined with any of the aspects herein, the presentation of the display programming is also adjusted by periodically skipping one or more frames of the display programming.

In another aspect that may be combined with any of the aspects herein, periodically skipping one or more frames of the display programming decreases the duration of the display programming.

In another aspect that may be combined with any of the aspects herein, the presentation of the display programming is adjusted by skipping one or more frames of the display programming when the exercise rate of the user is greater than the default exercise rate.

In another aspect that may be combined with any of the aspects herein, the presentation of the display programming is adjusted by skipping one or more frames of the display programming at regular intervals when the exercise rate of the user is greater than the default exercise rate.

In another aspect that may be combined with any of the aspects herein, the presentation of the display programming is adjusted by skipping one or more frames of the display programming at irregular intervals when the exercise rate of the user is greater than the default exercise rate.

In another aspect that may be combined with any of the aspects herein, the exercise rate of the user is determined by at least one of the user's speed, the speed of the movable element, a resistance applied to the moveable element, a degree of incline of the movable element, and a degree of tilt of the movable element.

In another aspect that may be combined with any of the aspects herein, the presentation of the display programming is adjusted by periodically skipping one or more frames of the display programming when the exercise rate of the user is greater than the default exercise rate.

In another aspect that may be combined with any of the aspects herein, the one or more frames of the display programming that are skipped are evenly spread out during the portion of the display programming presented to the user while the exercise rate of the user is greater than the default exercise rate.

In another aspect that may be combined with any of the aspects herein, the presentation of the display programming is adjusted by i) periodically pausing the display programming when the exercise rate of the user is less than the default exercise rate, and ii) periodically skipping one or more frames of the display programming when the exercise rate of the user is greater than the default exercise rate.

In another aspect that may be combined with any of the aspects herein, the periodic pausing of the display programming and the periodic skipping of one or more frames are done at generally regular intervals when the exercise rate of the user is less than or greater than the default exercise rate.

In another aspect that may be combined with any of the aspects herein, an exercise system includes a movable element, a controller, and a display.

In another aspect that may be combined with any of the aspects herein, the controller is operatively associated with the movable element.

In another aspect that may be combined with any of the aspects herein, the controller determines a distance traveled by the user based on the exercise rate of the user.

In another aspect that may be combined with any of the aspects herein, the display presents display programming to the user that includes a plurality of images taken along a real world trail.

In another aspect that may be combined with any of the aspects herein, each of the plurality of images is assigned a distance value.

In another aspect that may be combined with any of the aspects herein, each image from the plurality of images is presented to a user until the user's traveled distance is equal to the distance value assigned to the presented image.

In another aspect that may be combined with any of the aspects herein, each image is taken at a known geographic location along the real world trail.

In another aspect that may be combined with any of the aspects herein, the assigned distance value for an image is generally equal to the distance along the real world trail between the geographic location where the image was taken and the geographic location where a subsequent image was taken.

In another aspect that may be combined with any of the aspects herein, the geographic locations for the images are known using a GPS device.

In another aspect that may be combined with any of the aspects herein, the display programming skips some of the images when the distance value assigned to the images is relatively short, when the user's exercise rate is relatively high, or a combination thereof.

In another aspect that may be combined with any of the aspects herein, the images of the display programming are presented at a higher rate when the user's exercise rate increases.

In another aspect that may be combined with any of the aspects herein, the images of the display programming are presented at a lower rate when the user's exercise rate decreases.

In another aspect that may be combined with any of the aspects herein, the exercise rate of the user is determined by at least one of the user's speed, the speed of the movable element, a resistance applied to the moveable element, a degree of incline of the movable element, and a degree of tilt of the movable element.

In another aspect of the disclosure, a method for correlating the presentation of display programming with an exercise rate includes creating display programming relating to a real world trail.

In another aspect that may be combined with any of the aspects herein, creating the display programming includes collecting geographic data relating to the real world trail.

In another aspect that may be combined with any of the aspects herein, creating the display programming includes collecting a plurality of images of the real world trail.

In another aspect that may be combined with any of the aspects herein, creating the display programming includes assigning each image a distance value based on the collected geographic data.

In another aspect that may be combined with any of the aspects herein, the method also includes displaying the display programming on a display associated with on exercise device.

In another aspect that may be combined with any of the aspects herein, the method also includes presenting a new image from the plurality of images each time the user of the exercise device travels a distance substantially equal to the distance value assigned to the previous image.

In another aspect that may be combined with any of the aspects herein, collecting geographic data includes collecting GPS coordinates along the real world trail.

In another aspect that may be combined with any of the aspects herein, collecting the plurality of images comprises taking a picture along the real world trail at a predetermined distance after a previous picture was taken.

In another aspect that may be combined with any of the aspects herein, assigning a distance value to each image comprises determining the distance between the geographic locations where the image was taken and where the previous image was taken.

DETAILED DESCRIPTION

The present invention is directed to exercise systems and devices, and particularly to exercise systems and devices that display videos or other images during exercise. Even more specifically, the exemplary embodiments disclosed herein relate to correlating the video or image playback to a user's rate of exercise and/or presenting images of the real world to the user based on the user's exercise rate.

Figure 1:
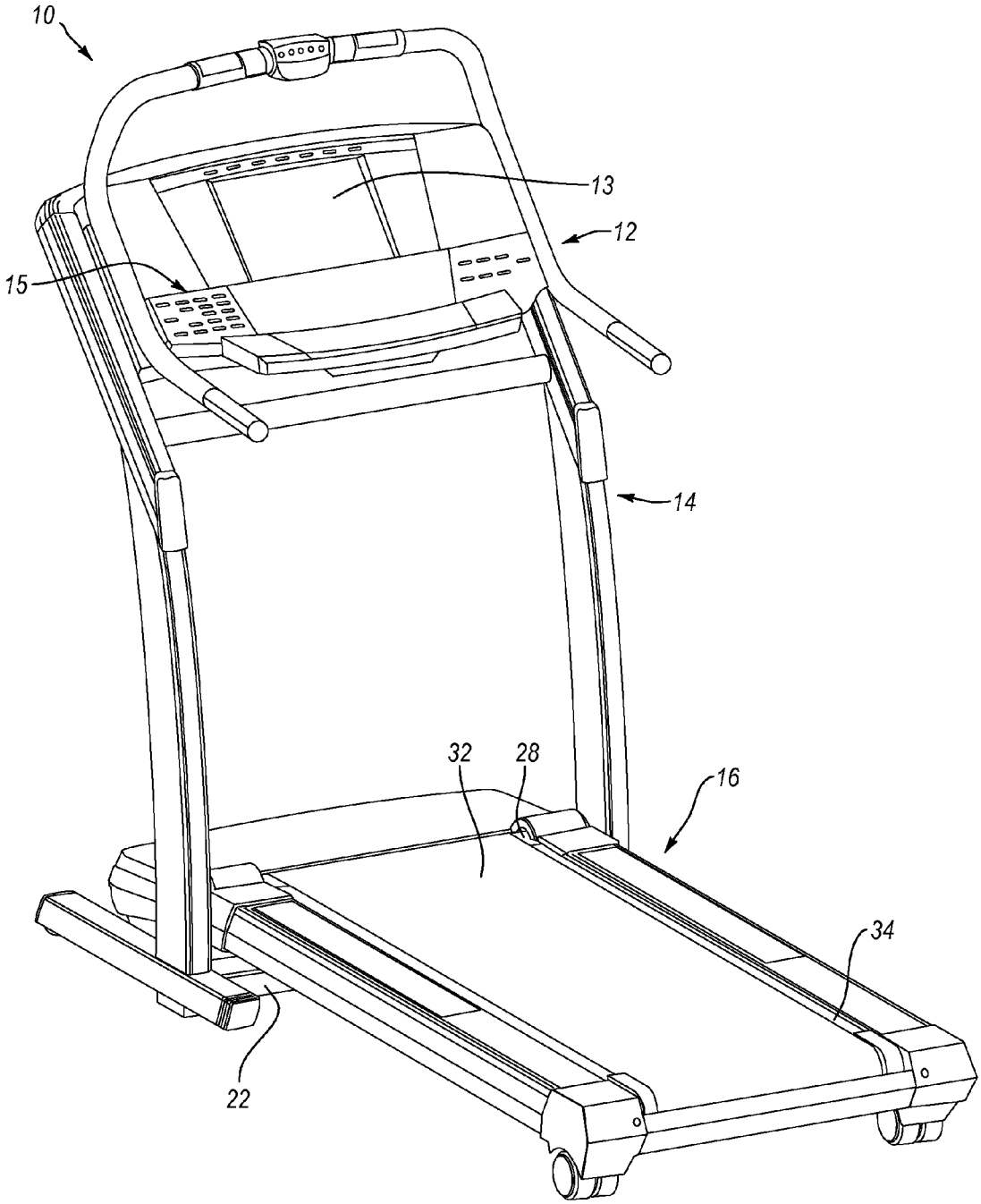
FIG. 1 illustrates an exemplary exercise device according to the present invention.

Depicted in FIG. 1 is a representation of one illustrative exercise device 10. Exercise device 10, which is illustrated as a treadmill, in one embodiment, includes a console or control panel 12 having a display 13 and various inputs 15. Control panel 12 is supported on a generally upright support structure 14. A treadbase 16 is mounted on base frame 22 and typically includes a front pulley 28 and a rear pulley 30 (not shown) with a continuous belt 32 extending between and around front and rear pulleys 28 and 30, respectively. Front and rear pulleys 28, 30 and continuous belt 32 may each be considered a movable element that is movable during the performance of an exercise. A deck 34, commonly fabricated from wood, typically supports the upper run of belt 32 and an exercising individual positioned upon belt 32.

As is common with electric treadmills, at least one of front pulley 28 and rear pulley 30 is mechanically connected to an electric tread drive motor 36 (not shown) by way of a drive belt 38 (not shown). Motor 36 is optionally electrically connected to a treadmill controller 40 (not shown) that controls the operation of motor 36, and thus the speed of belt 32, in response to various user inputs or other control signals. In addition to the ability to control and vary the speed of belt 32, treadmill 10 may also permit the degree of incline of treadbase 16 to be varied relative to the floor, or other support surface upon which treadmill 10 rests. Treadmill 10 may also permit treadbase 16 to be tilted from side to side in order to more closely replicate walking or running on outdoor terrain. The inclination, declination, and tilting of treadbase 16 can be accomplished through the use of various inclination and tilting mechanisms, as is known in the art. The operation of one or more aspects of exercise device 10 may be controlled, at least in part, by exercise programming that is stored by exercise device 10, or stored on a separate device (e.g., a remote server, personal computer, portable memory device) which communicates the exercise programming to exercise device 10.

The exercise programming may include one or more control signals that control one or more operating parameters of exercise device 10, such as the speed of the movable element, incline/tilt of the movable element, difficulty of exercise program, time, distance, and the like of an exercise program performed on exercise device 10. The exercise programming may also include display programming that is presented to a user on display 13 during exercise. The display programming may include image data and/or image data that has been formatted or manipulated so that it can be displayed on display 13 of exercise device 10. Examples of such display programming that can display images on display 13 include, for example, video programming, sequential static image programming, and/or a single image of, for example, real world terrain that may optionally be simulated by exercise device 10.

The control signals and the display programming may be synchronized so that the operating parameters of exercise device 10 correspond to the images displayed by the display programming. For instance, if the display programming displays one or more images of a hill that has an 8% grade and is ¼ mile long, the control signals may adjust the incline of the movable element to simulate the 8% grade until the user has walked for ¼ mile. The display programming may then display one or more images of terrain having different characteristics. The control signals may adjust the operating parameters of exercise device 10 to simulate the terrain shown in the newly displayed images. Synchronizing the control signals and the display programming in this manner may create a more realistic simulation of an actual outdoor experience for the user.

While the synchronization of the control signals and the display programming enables exercise device 10 to simulate the terrain displayed by the display programming, to more accurately simulate an actual outdoor exercise experience, the display programming may also be correlated with the user's rate of exercise or at least one of the operating parameters of exercise device 10 (e.g., the speed). For instance, the duration or the playback or presentation rate of the display programming may need to be increased or decreased if the user increases or decreases the speed of the movable element.

If the duration or playback or presentation rate of the display programming is not correlated with the user's rate of exercise or at least one of the operating parameters of exercise device 10, then the display programming may become out of synch with the simulated terrain. For instance, using the previously mentioned 8% grade, ¼ mile long hill example, if the user increases the speed of the movable element from two miles per hour (mph) to four mph, the user would be able to "run up the hill" and ¼ mile beyond before the display programming finished displaying the images of the hill. Accordingly, as discussed in detail below, the duration or playback or presentation rate of the display programming can be related to the user's rate of exercise, as indicated by the speed of the movable element, for example.

Exercise device 10 can monitor the actual operating parameters of exercise device 10, such as the speed of the movable element or the incline and tilt of the movable element. The monitoring of the operating parameters of exercise device 10 can be accomplished in any number of ways. For instance, exercise device 10 may include one or more sensors (not shown) that detect the actual operating parameters of exercise device 10. For instance, exercise device 10 may include a sensor that detects the number of revolutions the movable element, a drive belt, or a motor makes in a given time period. This value can be used to calculate how fast a user would be walking, running, or otherwise exercising on exercise device 10. Similarly, exercise device 10 may include sensors, such as proximity sensors, for detecting the incline/tilt of the movable element.

While the exercise programming has been described with synchronized control signals and display programming, the exercise programming may have other configurations. For instance, the control signals and the display programming may be partially or entirely asynchronous. Accordingly, the control signals may not adjust the operating parameters of exercise device 10 to simulate the terrain being displayed. Regardless of whether the control signals and the display programming are synchronized with one another, the duration or playback or presentation rate of the display programming may be correlated to the user's rate of exercise or at least one of the operating parameters of exercise device 10 (e.g., the speed of the movable element).

Thus, for example, even if the display programming displays terrain that is not simulated by exercise device 10, the duration or playback rate of the display programming may still correspond to how fast the user is exercising. For instance, the movable element may be set at a 1% grade while the display programming displays terrain having an 8% grade. Nevertheless, if the speed of movable element is at five mph, the display programming may display at a rate that would simulate the user moving along the displayed terrain at five mph. Furthermore, if the user increased or decreased the speed of the movable element, the duration or display rate of the display programming may be increased or decreased accordingly.

With attention to FIGS. 2-4, various exemplary method or process steps will be discussed for adjusting the presentation of the display programming according to one embodiment of the invention. Following the discussion of FIGS. 2-4, FIGS. 5-8 will be discussed, which illustrate various exemplary method or process steps for adjusting the presentation of the display programming according to other embodiments of the invention. In light of the disclosure herein, it is understood that the presentation of the display programming may be adjusted to maintain a synchronous relationship between the simulated and displayed terrain, or simply to maintain a temporal relationship between the user's rate of exercise and the presentation of the display programming (e.g., higher exercise rate leads to shorter duration and/or higher display rate of the display programming, and vice versa) regardless of whether exercise device 10 simulates the displayed terrain.

Figure 2:
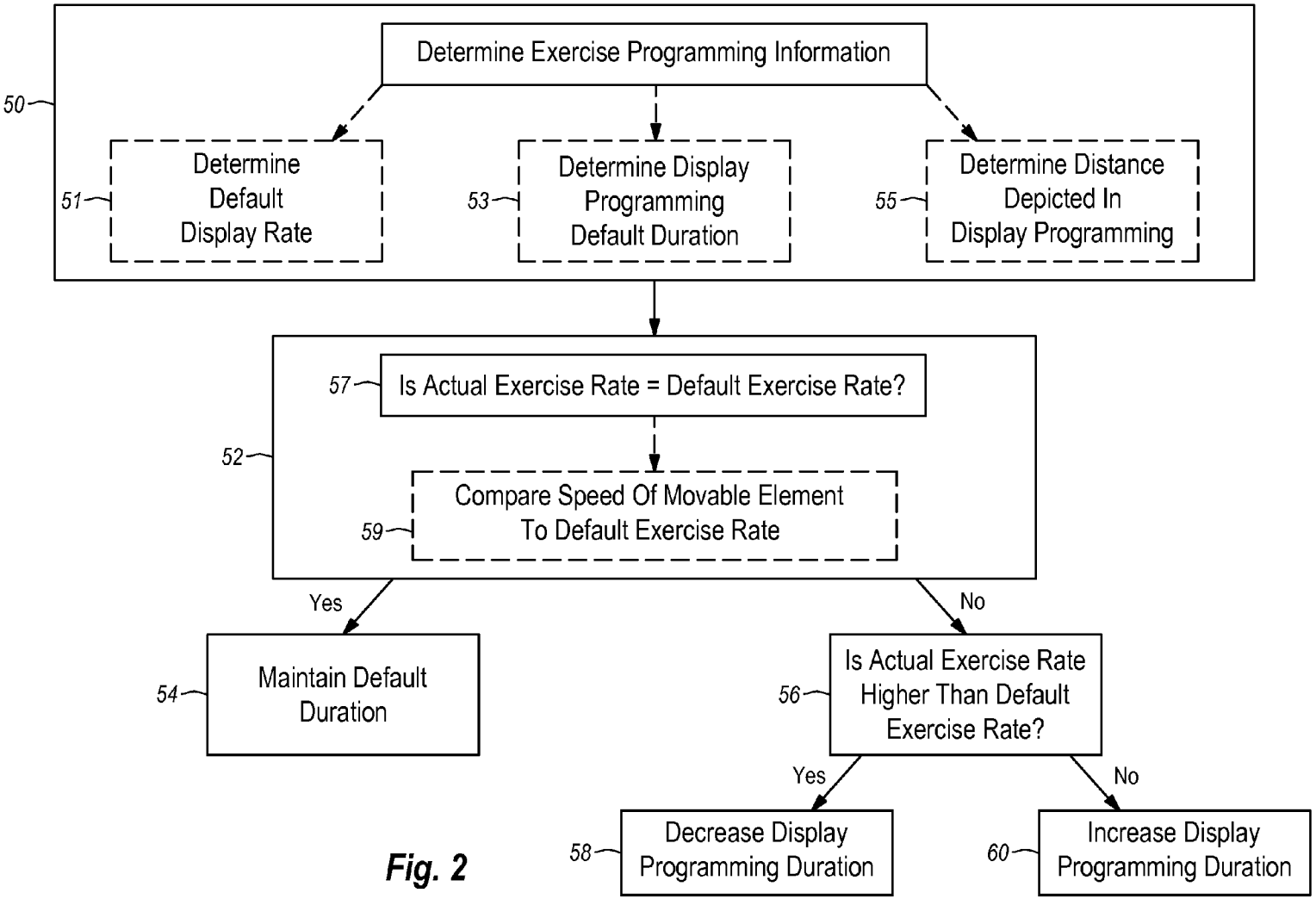
FIG. 2 is a functional block diagram of a general process for adjusting the playback of display programming to correlate the display programming to an exercise rate.

With specific attention to FIG. 2, a general process for correlating or maintaining the relationship between the display programming and the exercise rate is illustrated. The process may begin at step 50 by determining certain information about the exercise programming. One of ordinary skill in the art will recognize that the determination of this information, and the related calculations, may be performed during the creation of the exercise programming. Alternatively, exercise device 10 may make these determinations and calculations prior to or while running the exercise programming.

The determination of the information about the exercise programming may include determining baseline information about the exercise programming that may be used to correlate the display programming with the user's exercise rate. For instance, as shown at sub-step 51, the determination of the baseline information may include determining the default display rate for the display programming. Depending on the quality of the display programming, the default display rate may differ. For instance, very low quality display programming may have a frame rate as low as one frame every two or three seconds. Whereas, high quality display programming may have a frame rate of about 60 frames per second or higher. In addition to determining the default display rate for the display programming, this initial evaluation step may also determine the default duration of the display programming, as indicated in sub-step 53, or the distance of the course shown in the display programming, as indicated in sub-step 55. For instance, it may be determined that the display programming, running at the default display rate, runs for a default duration of thirty minutes. It may also be determined, for example, that the display programming depicts a route that is three miles long.

Using at least some of the information about the display programming, such as the information determined in sub-steps 51, 53, 55, a default exercise rate can be calculated. For instance, if the display programming includes a video of a three mile long route and the default duration of the video is 15 minutes, then a default exercise rate of five mph can be calculated. Accordingly, the display programming may be displayed at the default display rate as long as the user runs on exercise device 10 at five mph. If the user exercises faster or slower on exercise device 10, the duration of the display programming may be increased or decreased to correlate or maintain the relationship between the display programming and the exercise rate. In other words, the duration of the display programming may be adjusted based on the user's exercise rate so that the display programming runs for approximately the same amount of time as the user is exercising.

The next step in the process for correlating or maintaining the relationship between the display programming and the exercise rate is shown at step 52. Specifically, at step 57 it is determined whether the actual exercise rate is the same as the default exercise rate. As indicated at step 59, this determination may be made by comparing the actual exercise rate (e.g., the speed at which the user is exercising on exercise device 10 as indicated by the speed of the movable element, for example) to the default exercise rate. As discussed above, exercise device 10 may include sensors or other mechanisms for monitoring the speed of the movable element, for instance, thereby allowing exercise device 10 to determine the actual exercise rate of the user. If the user's actual exercise rate is the same as the default exercise rate, the default duration of the display programming is maintained, as shown in step 54. That is, as long as the user exercises on exercise device 10 at the default exercise rate, the display programming may be presented at the default display rate and over the default duration to maintain the relationship between the exercise rate and the display programming.

However, if the actual exercise rate is not the same as the default exercise rate, the process moves to step 56 where it is determined whether the actual exercise rate is higher than the default exercise rate. Again, this determination may be made by comparing the actual exercise rate (e.g., the speed at which the user is exercising on exercise device 10 as indicated by the speed of the movable element, for example) to the default exercise rate. If the actual exercise rate of the user is higher than the default exercise rate (e.g., the user is running faster than five mph), then the process moves to step 58, where the duration of the display programming is decreased to maintain the relationship between the exercise rate and the display programming. An exemplary process for decreasing the duration of the display programming is discussed in greater detail below in connection with FIG. 3.

If it is determined at step 56 that the actual exercise rate is not higher than the default exercise rate, then, by process of elimination, it is known that the actual exercise rate is lower than the default exercise rate. At this point, the process moves to step 60, where the duration of the display programming is increased to maintain the relationship between the exercise rate and the display programming. An exemplary process for increasing the duration of the display programming is discussed in greater detail below in connection with FIG. 4.

Figure 3:
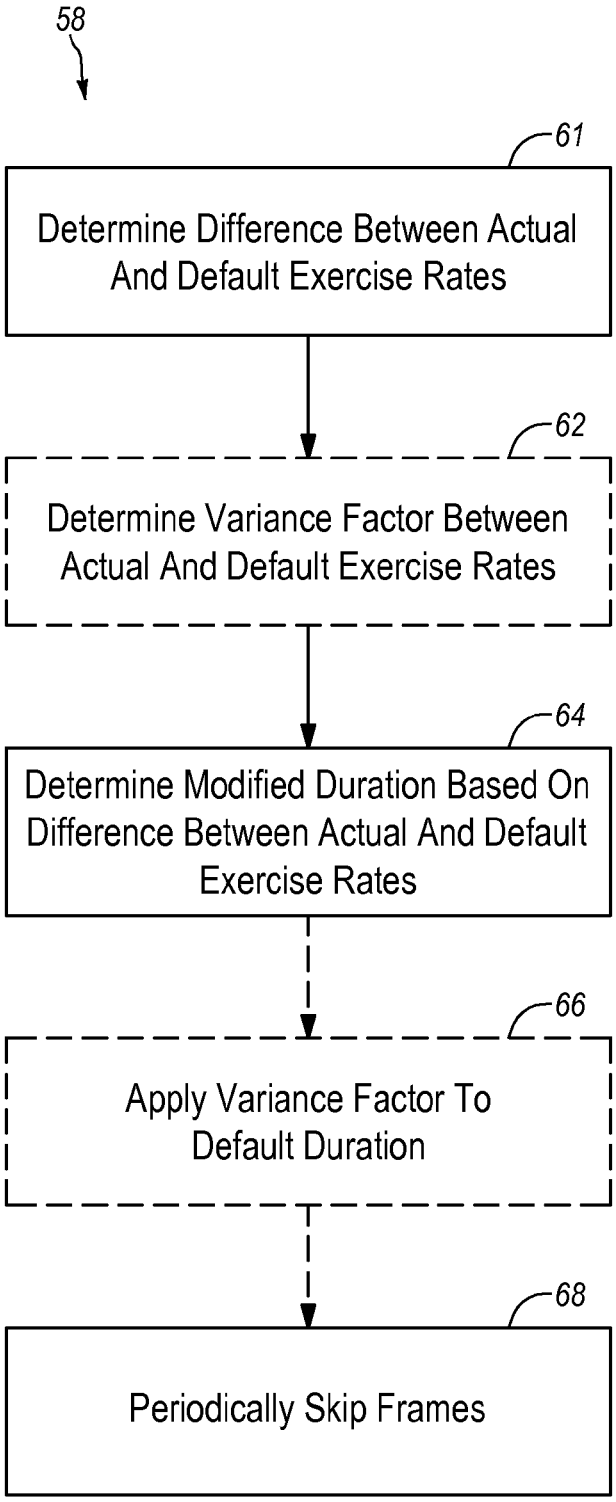
FIG. 3 is a functional block diagram of an exemplary process for decreasing the duration of display programming.

Turning to FIG. 3, an exemplary process for decreasing the duration of the display programming is illustrated. As discussed above, once it is determined at step 56 that the actual exercise rate is higher than the default exercise rate, the process moves to step 58, where the duration of the display programming is decreased to maintain the relationship between the exercise rate and the display programming.

As shown at step 61 in FIG. 3, the process for decreasing the duration of the display programming may include determining the difference between the actual exercise rate and the default exercise rate. For instance, if the default exercise rate is five mph and the actual exercise rate is seven and one-half mph, the difference between the two rates is an increase of two and one-half mph. A variance factor between the actual and default exercise rates may be determined in optional step 62. Continuing with the previous example, for instance, a two and one-half mph increase in the actual exercise rate over the five mph default exercise results in a variance factor of one and one-half. In other words, the actual exercise rate is 50% higher than the default exercise rate. In this example, increasing the actual exercise rate by a variance factor of one and one-half or 50% more than the default exercise rate results in the user exercising fast enough to complete the course displayed in the display programming in a time that is about ⅔ the original length of the display programming.

As a result of a difference between the actual exercise rate and the default exercise rate, the duration of the display programming is decreased in order to maintain the relationship between the exercise rate and the display programming, as indicated in step 58 of FIG. 2. More specifically, at step 64 of FIG. 3, a modified duration for the display programming is determined using the difference between the actual and default exercise rates. In other words, the duration of the display programming is adjusted so that the duration of the display programming corresponds to the time it will take the user to traverse the depicted course at the user's actual exercise rate. For instance, in the above example, the duration of the display programming is decreased sufficiently so that the total length of the display programming is about ⅔ of its original length.

The modified duration may be calculated in various manners. For instance, one optional method for determining the modified duration is indicated in step 66. According to step 66, the variance factor determined in step 62 is applied to the default duration. As is known, over a given distance, rate and time are inversely proportional to one another. Accordingly, when the display programming depicts a course of a specific length and the exercise rate is increased by a known variance factor, then the time during which the display programming depicts the course must be decreased by the known variance factor. For instance, if the actual exercise rate is increased over the default exercise rate by a variance factor of 1.5, then the time during which the display programming displays the course must be decreased by the 1.5 variance factor (e.g., a 30 minute display programming must be presented in 20 minutes).

Decreasing the total time for presenting the display programming by the variance factor requires decreasing the duration of the display programming by the variance factor. In other words, in order to present the depicted course from beginning to end in a period of time shortened by a variance factor, the default duration will need to be decreased by the variance factor. As discussed below, decreasing the default duration by the variance factor may include reducing the number of frames of the display programming that are presented to the user.

The present system may monitor the actual exercise rate compared to the default exercise rate and determined the difference therebetween at specified intervals, such as every fifty milliseconds (ms) or more or less frequently, or on a substantially continuous and ongoing basis. Regardless of the frequency of the monitoring and calculations, once the difference between the actual and default exercise rates is determined, the system may adjust the duration of the display programming accordingly to maintain the relationship between the exercise rate and the display programming. Thus, if the user exercises at the default exercise rate for a portion of the exercise programming and above or below the default exercise rate for other portions of the exercise programming, the duration of the display programming may be adjusted to maintain the desired relationship between the exercise rate and the display programming throughout the entire exercise program. That is, the duration of the display programming may be left at the default duration when the user is running at the default exercise rate while also being adjusted during the times the user is running faster or slower than the default exercise rate.

As noted elsewhere herein, adjusting the presentation of the display programming may be accomplished by modifying playback speed or display rate of a video, such as by altering the duration time stamps on each frame of the video so that each frame is displayed for a longer or shorter period of time. This type of process requires a complex program to perform the necessary calculations and the like. To provide a simpler, more efficient system, the present process does not modify duration time stamps that may exist in the display programming. Rather, the present process adjusts the duration of the display programming by periodically skipping frames to decrease the duration of the display programming, as indicated in step 68 of FIG. 3.

By way of example, if the display programming has a default display rate of twenty-five frames per second, a default duration of thirty minutes, and the actual exercise rate is increased by a variance factor of one and one-half (e.g., 50% higher than the default exercise rate), the user will run far enough to complete the course displayed in the display programming in a time that is about ⅔ the original time of the display programming. Accordingly, to shorten the display programming to about ⅔ its default duration, the variance factor is be applied to the display programming to reduce the number of frames presented to the user. The reduction in the number of frames presented to the user may be accomplished by periodically skipping frames.

For instance, with a display rate of twenty-five frames per second for a thirty minute workout at the default exercise rate of five mph, the display programming would include about 45,000 frames. In order to shorten the display programming to about twenty minutes (e.g., the time it would take the user to run the length of the displayed workout at seven and one-half mph), about ⅓ of the frames (e.g., 15,000) would be skipped. In other words, the number of frames presented to the user would be reduced from the total number of frames in the display programming by the variance factor (e.g., 45,000/1.5=30,000).

In order to present the display programming in a relatively smooth manner that appears to the user as a complete course from beginning to end, the skipped frames can be spread throughout the display programming, rather than simply skipping the end of the display programming. In the example described above, for instance, the system may skip every third frame. In another exemplary embodiment, about every one hundred twenty milliseconds (ms) the system may skip a frame. In still other embodiments, the system may skip multiple frames at once. For instance, every two hundred forty ms the system may skip two frames. Accordingly, the system may periodically skip frames at regular intervals, either based on time or the number of displayed frames, to shorten the display programming to maintain the relationship between the display programming and the exercise rate (e.g., the display programming will be displayed at a rate that is commensurate with the user's actual rate of exercise).

Notably, the present embodiment allows for the display programming to be presented at the default display rate regardless of whether the user exercises at or above the default exercise rate or whether the actual duration of the display programming is the same as or shorter than the default duration. This is made possible by adjusting both the number of frames and the duration of the display programming by the same variance factor. As a result, the display programming may be presented to the user is a smooth consistent manner throughout.

It will be appreciated that the specific values identified herein (e.g., display rates, exercise rates, durations, frames, times, etc.) are provided merely by way of example. The system may adjust the presentation of the display programming by periodically skipping frames as discussed herein regardless of the default duration, the default display rate, the difference between the default and actual exercise rates, and the like. It will also be understood that the system may skip frames at non-regular intervals to maintain the relationship between the display programming and the exercise rate. By way of non-limiting example, the system may skip a frame after one hundred twenty ms, then skip two frames after sixty ms, then skip one frame after two hundred ms, and the like.

Figure 4:
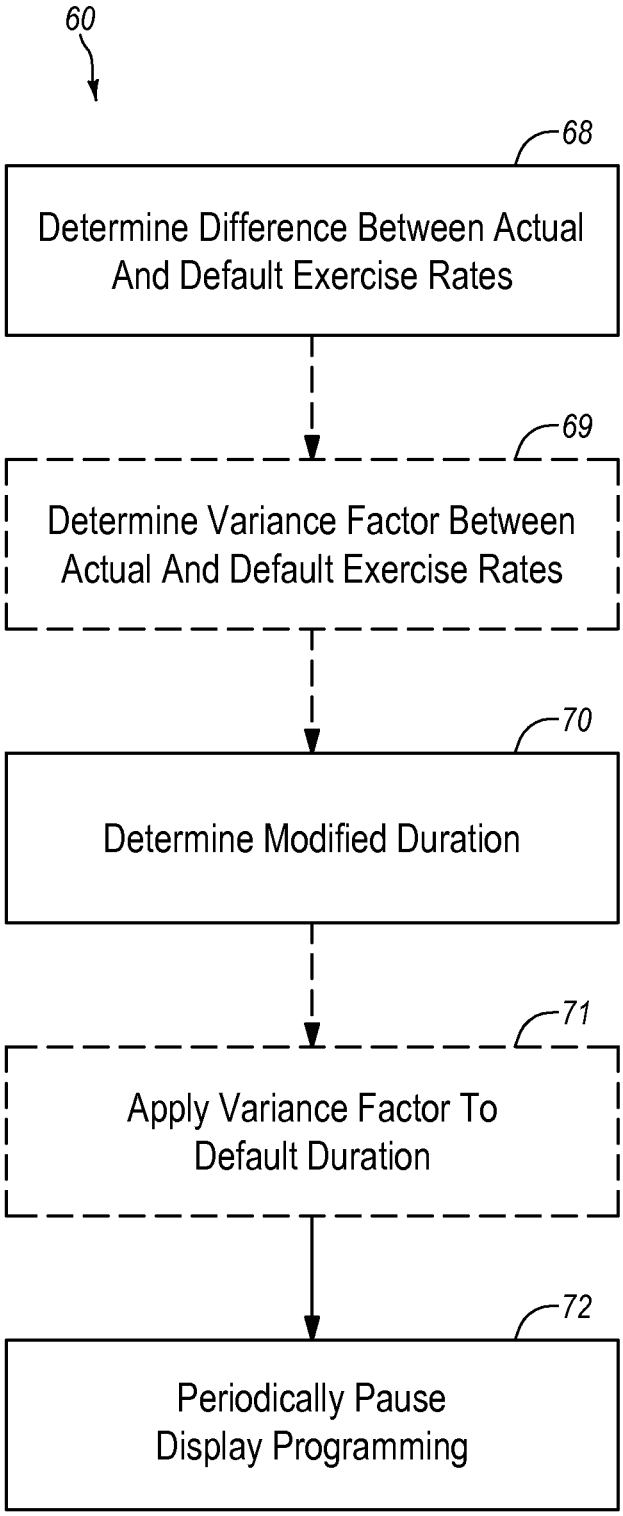
FIG. 4 is a functional block diagram of an exemplary process for increasing the duration of display programming.

Attention is now directed to FIG. 4, which illustrates an exemplary process for increasing the duration of the display programming. As discussed above, once it is determined at step 56 that the actual exercise rate is lower than the default exercise rate, the process moves to step 60, where the duration of the display programming is increased to maintain the relationship between the exercise rate and the display programming.

Similar to the process described in connection with FIG. 3, the process for increasing the duration of the display programming may include determining the difference between the actual exercise rate and the default exercise rate, as shown at step 68 in FIG. 4. For instance, if the default exercise rate is five mph and the actual exercise rate is two and one-half mph, the difference between the two rates is a decrease of two and one-half mph. A variance factor between the actual and default exercise rates may be determined in optional step 69. Continuing with this example, a two and one-half mph decrease in the actual exercise rate relative to the five mph default exercise rate results in a variance factor of one-half. In other words, the actual exercise rate is 50% of the default exercise rate. Decreasing the actual exercise rate by a variance factor of one-half or 50% of the default exercise rate results in the user taking twice as long to run far enough to complete the course displayed in the display programming. In other words, if the display programming depicts a 1⅔ mile course that would take twenty minutes to run at the five mph default exercise rate, it would take the user forty minutes to run the 1⅔ mile course at the actual exercise rate of two and one-half mph.

As a result of a difference between the actual exercise rate and the default exercise rate, the duration of the display programming is increased in order to maintain the relationship between the exercise rate and the display programming. More specifically, at step 70, a modified duration for the display programming is determined using the difference between the actual and default exercise rates. In other words, the duration of the display programming is adjusted so that the duration of the display programming corresponds to the time it will take the user to traverse the depicted course at the user's actual exercise rate. For instance, in this example, the duration is increased sufficiently so that the total length of the display programming is about twice as long as its original length (e.g., about 40 minutes).

Similar to the discussion of steps 64 and 66 above, the modified duration identified in step 70 may be calculated in various manners. For instance, one optional method for determining the modified duration is indicated in step 71. According to step 71, the variance factor determined in step 69 is applied to the default duration. When the display programming depicts a course of a specific length and the exercise rate is decreased by a known variance factor, the time during which the display programming depicts the course must be increased by the known variance factor (e.g., modified duration=default duration/variance factor). For instance, if the actual exercise rate is decreased relative to the default exercise rate by a variance factor of one-half, then the time during which the display programming displays the course must be increased by the one-half variance factor (e.g., twenty minute display programming must be presented in forty minutes). In other words, in order to present the depicted course from beginning to end in the same period of time it will take the user to complete the course, the duration of the display programming needs to be increased by same variance factor determined from the difference between the actual and default exercise rates. As discussed below, increasing the duration of the display programming by the variance factor may include periodically pausing the display programming.

As noted above, the present system may monitor the actual exercise rate compared to the default exercise rate and determine the difference therebetween and/or the variance factor continuously or at specified intervals. In either case, once the difference between the actual and default exercise rates or the variance factor is determined, the system may determine the needed increase in the duration of the display programming, as indicated in step 70, to maintain the relationship between the exercise rate and the display programming. Rather than modify the duration time stamps on each frame of the video to adjust the length of the display programming as discussed elsewhere herein, the present system increases the duration of the display programming by periodically pausing the display programming, as indicated at step 72 in FIG. 4.

In order to present the display programming to the user in a manner that appears relatively smooth from beginning to end, the display programming may be briefly paused at various points while the user is exercising at a rate that is below the default exercise rate. In the example described above where the actual exercise rate was half the default exercise rate, for instance, the system may pause the display programming for one hundred ms every one hundred ms. Pausing the display programming for one hundred ms every one hundred ms will effectively double the duration of the display programming. Alternatively, the system may pause the display programming every fifty ms for fifty ms, or at other rates that effectively double the length of the display programming.

The system may pause the display programming at different intervals, whether regularly spaced or not. By way of non-limiting example, the system may pause the display programming every twenty-five ms, fifty ms, seventy-five ms, one hundred ms, two hundred ms, at other intervals, or combinations thereof. Rather than basing the pausing intervals on time, the pausing intervals may be determined by the number of frames displayed. For instance, the system may pause the display programming after six frames have been displayed. Similarly, the length of each pause may be the same or different from other pauses. For example, the length of pauses may be twenty-five ms, fifty ms, one hundred ms, other lengths, or combinations thereof.

Accordingly, to lengthen the duration of the display programming to maintain the relationship between the display programming and the exercise rate (e.g., the display programming will be displayed at a rate that is commensurate with the user's actual rate of exercise), the system may periodically pause the display programming for regular or irregular lengths of time and at regular or irregular intervals, either based on time or the number of displayed frames. Thus, it will be appreciated that the specific values identified herein (e.g., display rates, durations, exercise rates, frames, times, pause intervals, pause durations, etc.) are provided merely by way of example. The system may adjust the duration of the display programming by periodically pausing frames as discussed herein regardless of the default display rate, the difference between the default and actual exercise rates, default duration, and the like.

As noted above, the display programming is periodically paused when the user is exercising at a rate that is below the default exercise rate. As a result, the number of frames presented to the user during a given time period (e.g., the actual display rate of the display programming) may be lower than the default display rate of the display programming. Nevertheless, when the display programming is not paused, the display programming may be presented to the user at the default display rate. In other words, when the user is exercising below the default exercise rate, the display programming may be played or paused. During the time the display programming is being played (i.e., the times between pauses), the display programming is presented at the default display rate.

Attention is now directed to FIGS. 5-8, which illustrate process steps for creating display programming and correlating the display programming with a user's exercise rate. More specifically, FIGS. 5-8 illustrate exemplary process steps for correlating images of real world locations with geographic data for the real world locations and presenting the real world images to the user based on the user's exercise rate.

Figure 5:
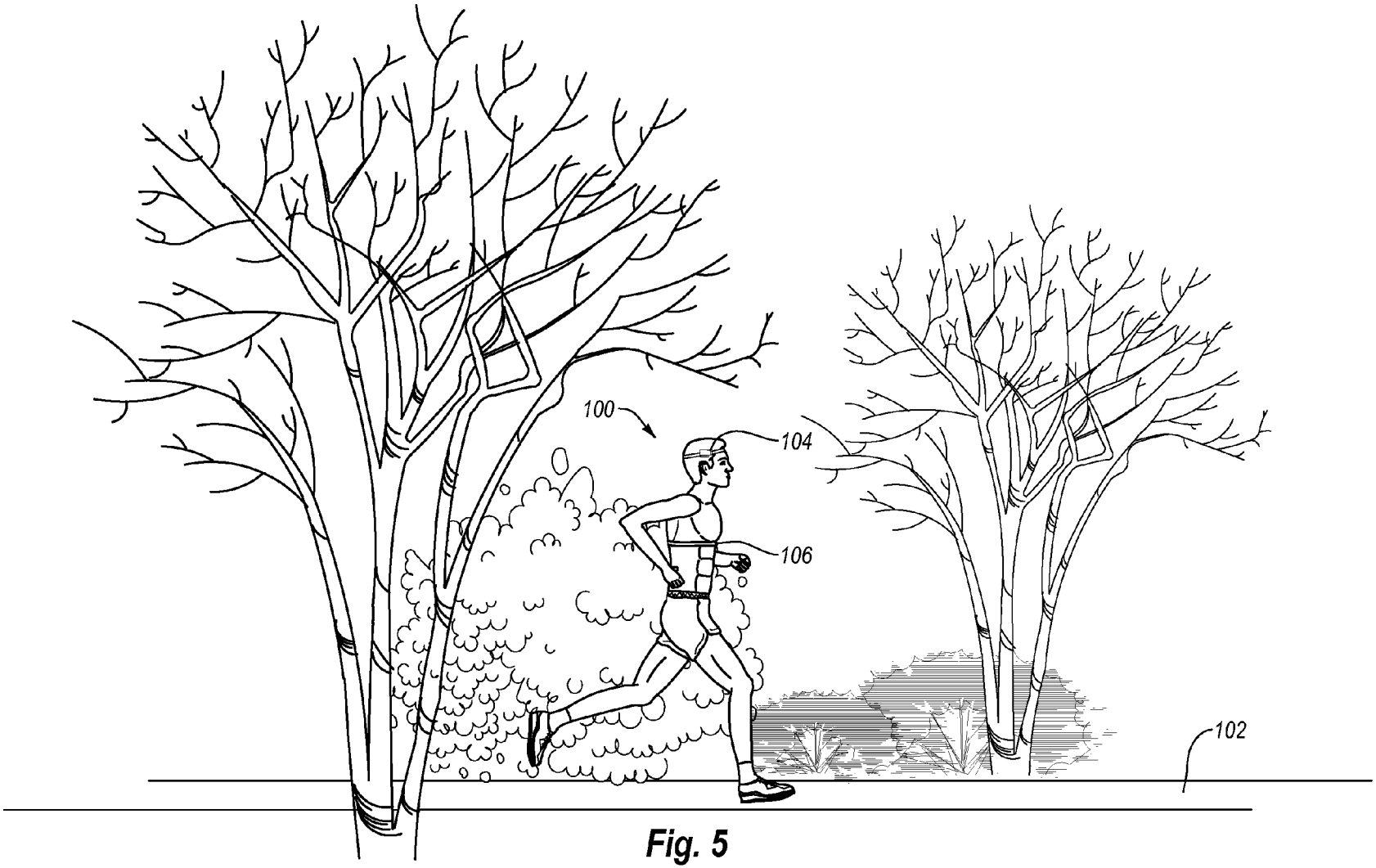
FIG. 5 depicts a person running along a real world trail colleting image and geographic data for exercise programming.

FIG. 5 illustrates a person 100 running along a real world trail 102 collecting data for inclusion in exercise programming. The data being collected may include image data, including sequential static images and/or video. As shown in FIG. 5, the image data may be collected using a camera 104 held or warn by person 100. Additional data being collected may include geographic data relating to trail 102 and its surroundings. For instance, the geographic data may include location data (e.g., GPS coordinates), topographical data (e.g., slope in one or more directions), altitude data, and the like. The geographic data may be collected by one or more suitable devices, shown in FIG. 5 as device 106. For example, device 106 may be a GPS receiver, an altimeter, pedometer, accelerometer, combinations thereof, and the like.

In some embodiments, device 106 may collect all the geographic data needed for the exercise programming. In other embodiments, device 106 may collect some of the geographic data, which may then be used to determine the other geographic data needed. For instance, device 106 may be a GPS receiver that collects GPS coordinates along trail 102 as person 100 runs therealong. The collected GPS data may then be used along with data from a database or other source to determine the other geographic data needed for the exercise programming. For example, the collected GPS data may be used in conjunction with topographical data available from a database to determine the slope between two points along trail 102.

According to the embodiment shown in FIG. 5, camera 104 and device 106 are separate devices that are warn or carried by person 100. In other embodiments, however, camera 104 and device 106 may be mounted on a vehicle, such as a bicycle, motorcycle, snowmobile, scooter, car, or the like. Furthermore, camera 104 and device 106 may be incorporated into a single unit that collects both geographic data and image data.

Figure 6:
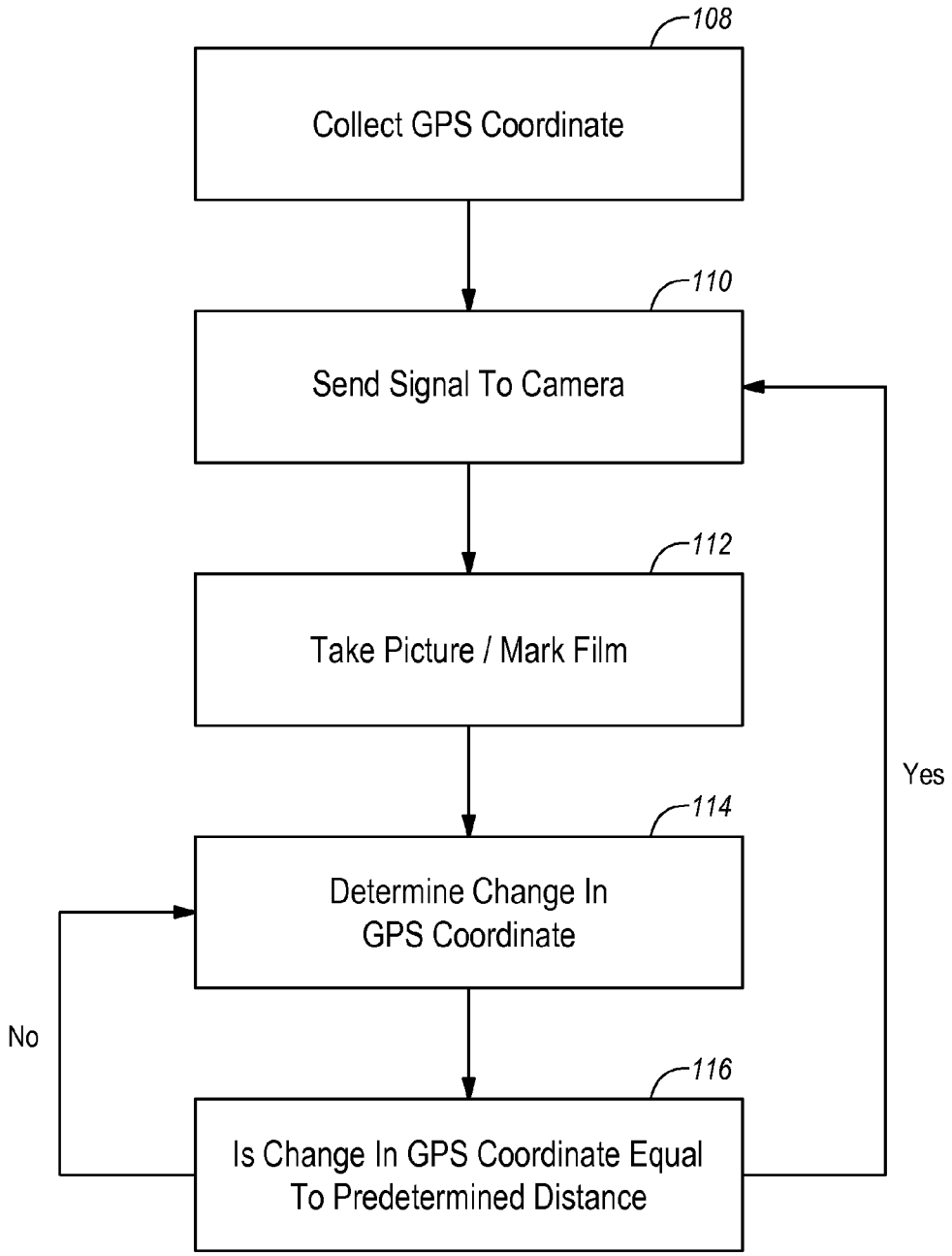
FIG. 6 is a functional block diagram of an exemplary process for collecting and correlating image and geographic data for exercise programming.

Regardless of whether camera 104 and device 106 are separate or part of a single unit, the data collected thereby may be correlated so that each collected GPS coordinate is associated with at least one image of the real world location at the GPS coordinate. FIG. 6 illustrates a block diagram showing one exemplary method for correlating the collected data. According to the method of FIG. 6, at least some of the collected data is correlated substantially simultaneously with the collection of the data. To facilitate the substantially simultaneous collection and correlation of the data, camera 104 and device 106 may communicate with one another either through a wired or wireless connection.

The method of FIG. 6 begins at step 108 with device 106 collecting or storing a GPS coordinate for the location at which person 100 is positioned. Upon collection of the GPS coordinate, device 106 sends a signal to camera 104 in step 110. If camera 104 takes still frame images, the signal from device 106 may cause camera 104 to take a picture substantially at the location where the GPS coordinate is collected, as indicated in step 112. In contrast, if camera 104 is a video camera, the signal from device 106 may tag or mark the video with the collected GPS coordinate substantially at the time the tagged portion of the video is taken. In this manner the image data and geographic data may be correlated to one another.

Camera 104 and device 106 may continue the process of collecting and correlating the image and geographic data while person 100 runs along trail 102. For instance, device 106 may be designed to collect or store a GPS coordinate whenever person 100 has moved a predetermined distance. As indicated in step 114 of FIG. 6, device 106 may monitor the location of person 100 and determine, based upon changes in GPS coordinates, how far person 100 has moved. The changes in GPS coordinates may be used to determine whether person 100 has moved the predetermined distance, as indicated in step 116. If person 100 has not moved the predetermined distance yet, the process returns to step 114. In contrast, if person 100 has moved the predetermined distance, the process returns to step 110, where a signal is sent to camera 106 to take a picture or mark the video. Thus, each time device 106 collects or stores a GPS coordinate that is a predetermined distance away from the previous GPS coordinate, device 106 sends a signal to camera 104 to cause camera 104 to take a picture or mark the video substantially at the collected or stored GPS coordinate.

In other embodiments, however, camera 104 and device 106 may not communicate with one another to correlate the image data and the geographic data. Rather, camera 104 may collect the image data and device 106 may collect the geographic data, and the collected data may be correlated later. For instance, camera 104 may collect the image data at a certain rate (e.g., 24 frames per second) and device 106 may track, in addition to the GPS coordinates, the speed of person 100 moving along trail 102. This separate data may be manipulated later to correlate the image data with the geographic data so that each image of trail 102 is linked to the location along trail 102 (e.g., the GPS coordinates) where the image was taken. Regardless of the correlation method, correlating the image data with the geographic data allows a user on exercise device 10 to be presented with images of real world locations at a rate that generally corresponds to the user's exercise rate.

The predetermined distance between the collection of each piece of geographic or image data may be set at a specific value. For instance, the predetermined distance may be set so that the display programming may be played back at a desired default frame rate. By way of example, the predetermined distance may be set so that the display programming is played backed to the user of exercise device 10 at a rate of sixty frames per second when the user is exercising at a default exercise rate, such as one mph. When the user is exercising at the default exercise rate, the entirety of the display programming may be presented to the user at the default frame rate.

The playback of the display programming may be adjusted when the user's exercise rate is above or below the default exercise rate. For instance, when the user is exercising below the default exercise rate, the frame rate of the display programming may be decreased. In contrast, when the user is exercising above the default exercise rate, the playback of the display programming may be altered while maintaining the default display rate, such as by decreasing the duration of the display programming through periodically skipping frames of the display programming.

Figure 7:
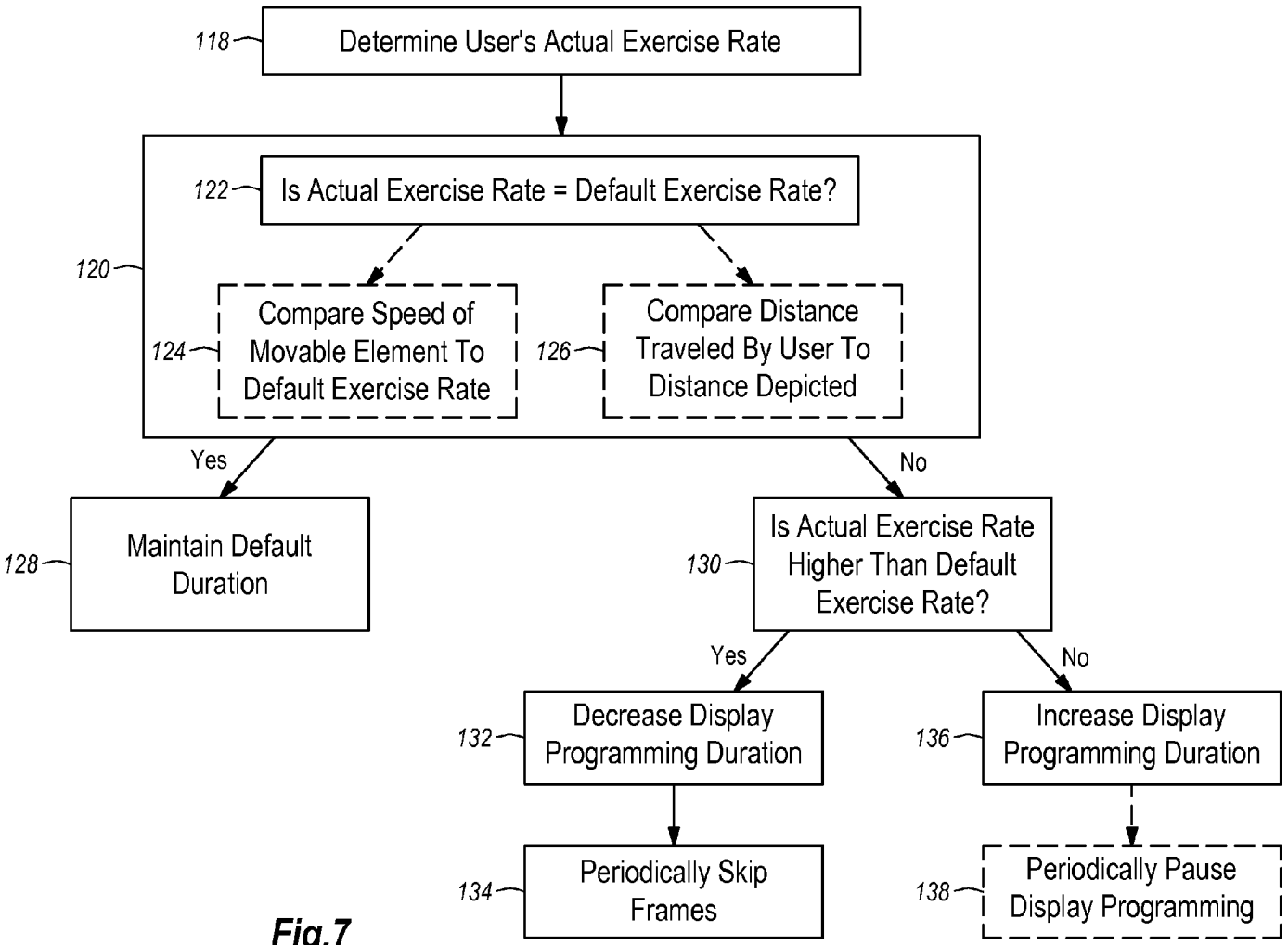
FIG. 7 is a functional block diagram of a general process for adjusting the playback of display programming to correlate the display programming to an exercise rate.

For instance, FIG. 7 illustrates one exemplary method for presenting images of the real world location to the user based on the user's exercise rate. The method begins in step 118, where the user's actual exercise rate is determined. This may be done by monitoring the speed of the movable element or other components of exercise device 10 as discussed herein. In step 120 it is determined if the user is exercising at the default exercise rate. Specifically, at step 122 it is determined whether the user's actual exercise rate is the same as the default exercise rate. As indicated at step 124, one option for making this determination is to compare the actual exercise rate (e.g., the speed at which the user is exercising on exercise device 10 as indicated by the speed of the movable element, for example) to the default exercise rate. As discussed above, exercise device 10 may include sensors or other mechanisms for monitoring the speed of the movable element, for instance, thereby allowing exercise device 10 to determine the actual exercise rate of the user.

Another option for determining whether the user's exercise rate is the same as the default exercise rate is indicated in step 126. Specifically, a comparison may be made between the distance the user has traveled and the distance depicted in the display programming during the same time period. If the user has traveled the same distance as that depicted in the display programming, then the user's exercise rate is the same as the default exercise rate. In contrast, if the user has traveled a distance that is either longer or shorter than the depicted distance, then the user's exercise rate is higher or lower, respectively, than the default exercise rate. Exercise device 10 may include sensors or other mechanisms for monitoring the distance traveled by the user over a given period of time, such as sensors for detecting the number of revolutions made by the movable element is a given period of time.

If the user's actual exercise rate is the same as the default exercise rate, then a default duration of the display programming is maintained, as shown in step 128. That is, as long as the user exercises on exercise device 10 at the default exercise rate, the display programming may be presented in its entirety at the default display rate to maintain the relationship between the exercise rate and the display programming.

However, if the actual exercise rate is not the same as the default exercise rate, the process moves to step 130 where it is determined whether the actual exercise rate is higher than the default exercise rate, which may be done using any method described herein. If the actual exercise rate of the user is higher than the default exercise rate (e.g., the user is running faster than one mph), then the process moves to step 132, where the duration of the display programming is decreased. As discussed herein, the length or duration of the display programming (e.g., the running time) may be adjusted to correlate the display programming with the user's exercise rate. Otherwise, for example, the user may run far enough to complete a course before the display programming finishes displaying the course.

According to the present embodiment, the duration of the display programming may be decreased by periodically skipping frames of the display programming, as indicated at step 134. The number of frames to be skipped can be determined in order to maintain the default display rate. Thus, for example, if the user's actual exercise rate was twice the default exercise rate, then half of the display programming frames would be skipped while the other half of the frames would be presented to the user at the default display rate. In this manner, the duration of the display programming may be adjusted to correspond to the time it will take the user to complete the course depicted in the display programming. Furthermore, by spreading the skipped frames out throughout the display programming, the display programming will still present a generally realistic depiction of the course from beginning to end.

Various processes can be used to determine the number of frames to be skipped, including a process similar to the process shown in FIG. 3. In particular, a variance factor can be calculated based on the difference between the actual exercise rate and the default exercise. The variance factor may then be applied to the display programming by dividing the total number of frames in the display programming by the variance factor. The resulting number will be the number of frames that may be presented to the user at the default display rate in the time it will take the user to complete the depicted course.

By way of example, if the default exercise rate was one mph, the default display rate was sixty frames per second, and the default duration of the display programming was thirty minutes, then the display programming would include 108,000 frames. If the actual exercise rate was four mph, then the variance factor would be four (e.g., four mph/one mph=variance factor of four). Dividing the 108,000 frames by the variance factor of four results in 27,000 frames that may be displayed to the user during the time it will take the user to travel far enough to complete the course depicted in the display programming.

Thus, like the previous embodiments, the display programming of the present embodiment may be presented to the user at a default display rate regardless of whether the user exercises at or above the default exercise rate or whether the actual duration of the display programming is the same as or shorter than the default duration.

Returning to FIG. 7, if it is determined at step 130 that the actual exercise rate is not higher than the default exercise rate, then, by process of elimination, it is known that the actual exercise rate is lower than the default exercise rate. At this point, the process moves to step 136, where the duration of the display programming is increased to maintain the relationship between the exercise rate and the display programming. Increasing the duration of the display programming may be accomplished in a variety of ways. For instance, as indicated at step 138, the display programming may be periodically paused, such as based upon a variance factor relating to the actual and default exercise rates. Alternatively, the default exercise rate may be set low enough that a lower actual exercise rate will result in the display programming presenting once or more static images to the user.

Figure 8:
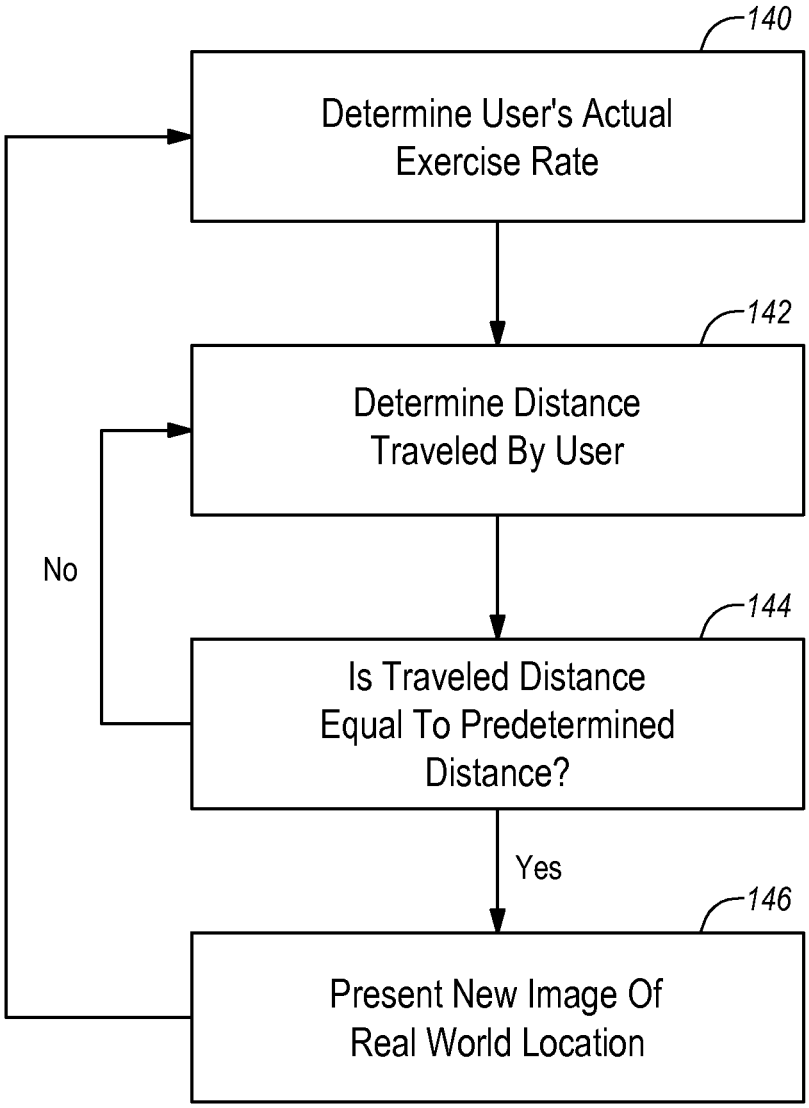
FIG. 8 is a functional block diagram of another general process for adjusting the playback of display programming to correlate the display programming to an exercise rate.

With attention to FIG. 8, there is illustrated an alternative process for adjusting the presentation of the display programming based on an exercise rate that is different from the default exercise rate. The process begins at step 140, where the user's actual exercise rate is determined in any manner discussed herein. In step 142 it is determined how far the user has traveled. This can be calculated using the exercise rate and the elapsed time. In step 144, the distance traveled by the user is then compared to a predetermined distance. The predetermined distance to which the traveled distance is compared to is the same predetermined distance used in collecting the geographic data, as described above. For example, if device 106 collects or stores a GPS coordinate at a predetermined distance of every inch, then the user's traveled distance is monitored to determine if he or she has traveled an inch. Other predetermined distances may be used. By way of non-limiting example, the predetermined distance may be equal to one half inch, one inch, two inches, six inches, twelve inches, three feet, and the like.

If it is determined in step 144 that the user has not traveled the predetermined distance, then the process returns to step 142. In contrast, if the user has traveled the predetermined distance, then a new image from the image data (e.g., a new image of trail 102) is presented to the user in step 146. After the new image is presented to the user, the process returns to step 140 where it is determined whether the user's exercise rate has changed, and the process continues on until the user has completed traversing the simulation of trail 102.

As a result, each time the user has traveled the predetermined distance, a new image of the real world location is presented to the user. The newly presented image corresponds to the location on real world trail 102 where the user would be if the user were actually traversing trail 102. By way of example, when the user has run a distance of five feet on exercise device 10, an image taken at the GPS coordinate five feet along trail 102 will be presented to the user. As the user continues to run on exercise device 10, new images will be presented to the user that correspond to the GPS coordinates at the distance along trail 102 that equal the distance the user has run.

In other words, each image of trail 102 may be assigned a distance value, such as the predetermined distance used when collecting the data for the exercise programming. Each image will be displayed on exercise device 10 until the user has run the distance assigned to each image. Once the user has run the distance assigned to the image being displayed, exercise device 10 will display the next image of trail 102 until the user has run the distance associated with the new image, and so on. It is understood that the predetermined distance may be relatively short so that the images of the display programming are presented relatively frequently. For instance, the predetermined distance may be short enough that the user is able to relatively quickly travel the predetermined distance, thereby triggering the presentation of a new image frequently enough that the display programming is presented at a relatively high frame rate.

While various values are presented herein for the predetermined distance between collected GPS coordinates and images of trail 102, these values are merely exemplary. Other predetermined distances may be used when collecting GPS coordinates and taking pictures of trail 102, and thus the distance values assigned to the images of trail 102. Furthermore, the GPS coordinates may be collected at uniform or non-uniform intervals. As a result, the images of trail 102 may be taken at uniform or non-uniform intervals and the distance values assigned to each image of trail 102 may be equal to or different than one another.

Returning to FIG. 8, if it is determined in step 140 that the user's exercise rate is higher or lower than a previous exercise rate, the rate at which the images of trail 102 are presented will be adjusted. For instance, if the user is exercising slower than before, it will take the user longer to traverse the predetermined distance or the distance assigned to the images of trail 102. As a result, new images of trail 102 will be presented at a less frequent rate (e.g., only when the user has traveled the predetermined distance or the distance assigned to the images of trail 102). Similarly, if the user is running faster than before, it will take the user less time to run the predetermined distance or the distance assigned to the images of trail 102. As a result, new images of trail 102 will be presented more frequently (e.g., as soon as the user has traveled the predetermined distance or the distance assigned to the images of trail 102).

Depending on the length of the predetermined distance (and thus the number of images of trail 102 in the display programming) and the user's exercise rate, it may be desirable to skip some of the images of trail 102 so that the images of trail 102 are presented in a fluid, realistic manner. For instance, if the predetermined distance or the distance assigned to the images of trail 102 is relatively short and the user's exercise rate is relatively high, then the display would have to present a new image of trail 102 at a high frequency.

By way of example, if device 106 collects a GPS coordinate and camera 106 takes a picture every one-half inch, then a new image of trail 102 would be presented to the user each time the user has traveled one-half inch. If the user is running on exercise device 10 at a rate of about 6 mph, for example, then a new image of trail 102 would have to be presented about every 0.0047 seconds.

Rather than presenting a new image of trail 102 at such a high frequency, one or more of the images of trail 102 may be skipped as described herein. In other words, rather than presenting a new image each time the user has traveled the predetermined distance (e.g., one-half inch), the system may present a new image of trail 102 at a rate that is closer to a standard display rate (e.g., twenty-four frames per second, fifty frames per second, sixty frames per second, seventy frames per second, etc.). According to the present example (e.g., a predetermined distance of one-half inch and an exercise rate of 6 mph), the system may display a new image each time the user has traveled about one and one-half inches, one and three-quarter inches, two and one-quarter inches, or four feet. Displaying new images when the user has traveled these distances would be about the equivalent of displaying new images at the above-mentioned standard display rates.

Thus, according to the embodiments of FIGS. 5-8, the display programming may include images taken at specific distances or known locations along a real word route so that the images are associated with the specific distances or know locations along the real word route. The specific distances or know locations along the real word route may then be used to present the images to the user of exercise device 10 based on the user's exercise rate.

In addition to correlating the presentation of the display programming with the user's exercise rate, various additional features may be included in the display programming. For instance, the image data collected by camera 104 may include generally static scenery overlaid with images of moving elements. More particularly, the image data collected by camera 104 may include images of trails, mountains, lakes, buildings, streets, and other objects or scenery that are relatively stationary. Images of moving objects, such as birds, people, cars, waving tree branches and leaves, etc. may be overlaid on the images of the static objects/scenery. Overlaying the moving elements on the statics images may increase the realistic nature of the display programming, its aesthetic appeal, or other stimulatory quality. Furthermore, collecting image data relating to static objects/scenery and overlaying it with moving images may avoid playback distortions. That is, if the image data collected by camera 104 included moving objects, adjusting the playback rate of the collected images may result in distortions in the moving images, such as wheels turning backwards, and the like. To avoid these possible distortions, camera 104 may collect images of relatively static objects/scenery, which images act as a back drop to the images of moving elements. The playback rate of the back drop images may then be adjusted independently from the moving images so that both the images of both the static objects and the moving elements are presented to the user in a realistic manner.

INDUSTRIAL APPLICABILITY

In general, embodiments of the present disclosure relate to exercise systems that control the presentation of display programming based on the user's exercise rate. The system may include an exercise device, such as a treadmill, an exercise cycle, a Nordic style ski exercise device, a rower, a stepper, a hiker, a climber, an elliptical, or a striding exercise device, with one or more selectively adjustable operating parameters. The adjustable operating parameters allow the exercise device to simulate real-world terrain or otherwise vary the operation of the exercise device. For instance, a treadmill may have one or more adjustable incline mechanisms for allowing the treadmill to simulate a descent down a hill, an ascent up a hill, or traversing across a hill. The exercise device may also have one or more motors, brakes, or other mechanisms, that can alter the speed, resistance, and the like of the exercise performed on the exercise device. In addition, the exercise device may also present display programming to the user. The display programming may include visual representations of real-world terrain, whether or not that terrain is simulated by the exercise device. The combination of the adjustable operating parameters and the display programming creates a more enjoyable and realistic virtual experience for the user of the exercise device.

While exercise systems have attempted to create virtual experiences for users, the realistic nature of these virtual experiences has generally been limited. For instance, correlating the playback rate of display programming and the user's rate of exercise has been challenging. Systems that have attempted to achieve a high rate of correlation between the display rate and the exercise rate are typically very complex.

Embodiments of the present disclosure provide simple and efficient mechanisms for correlating the presentation of display programming with the user's exercise rate. For instance, the present system monitors the user's actual exercise rate and adjusts the presentation of the display programming to correspond to the user's exercise rate. Thus, for example, as the user runs faster on a treadmill, the duration of the display programming is decreased accordingly, and vice versa. As a result, the display programming is presented to the user in a manner that gives the user the sense of running through the displayed terrain at the same rate at which the user is actually running.

The duration of the display programming may be altered in various ways. For example, the display programming duration may be decreased by skipping frames. Skipping frames effectively shortens the total length of the display programming. Nevertheless, the display programming may still present a substantially complete course to the user. That is, even while skipping frames, the display programming may still present a generally realistic representation of a course from beginning to end. This is accomplished by skipping frames periodically throughout the display programming. For instance, every third frame may be skipped, or frames may be skipped at specific time intervals, such as skipping one frame every fifty ms. Skipping frames in this manner may be unnoticeable to a user.

Another way that the duration of the display programming may be altered is by periodically pausing the display programming. Periodically pausing the display programming effectively lengthens the total duration of the display programming. Nevertheless, the display programming may still present what appears to be a relatively smooth flowing representation to the user. That is, even with periodic pauses, the display programming may still present a generally realistic representation of the course. This is accomplished by periodically pausing throughout the display programming. For instance, the display programming may be paused at certain regular or irregular time intervals (e.g., every fifty ms, every one hundred ms, etc.) or after a certain number of frames have been displayed (e.g., pause after every third frame). The pauses may also be for specific durations (e.g., each pause is fifty ms, one hundred ms, etc.). The frequency and duration of the pauses may be short enough that the user does not notice that the display programming is being paused.

By skipping frames or pausing the display programming, the disclosed system allows for display programming to be presented to a user at a rate that corresponds to the user's exercise rate and in a manner that appears relatively smooth and complete to the user. Adjusting the duration of the display programming in this manner makes the virtual experience more realistic and enjoyable for the user.

Still another way of correlating the presentation of real world images with the user's exercise rate uses geographic data relating to the real world images and the user's exercise rate on the exercise device. The images of a real world trail may be taken at known locations or at known distances apart from one another (e.g., via GPS data). Each image may then be assigned a distance value that is about equal to the distance between the location where the image was taken and the location where the next image was taken. During playback of the images on the exercise device, the images may be presented to the user at a specific frame rate. If the user is exercising at a default exercise rate, then all of the images in the display programming are presented to the user. If the user increases the exercise rate above the default exercise rate, frames of the display programming are periodically skipped to maintain the specific frame rate. The skipped frames may be spread through the display programming so that the display programming still presents to the user a realistic depiction of the course from beginning to end.

Yet another way of correlating the presentation of real world images with the user's exercise rate is based on how far the user has traveled. Each image in the display programming is assigned a specific distance, and each image is presented until the user has traveled a distance that is about equal to the distance value assigned to each image. Thus, if a user increases or decreases his speed, it will take less or more time to travel the distance assigned to each image. As a result each image will be displayed for shorter or longer periods of time based on the user's exercise rate.

Nevertheless, as with other embodiments, there may be instances where not all of the images of the real world trail are presented to the user. For instance, if the assigned distance value for the images is very short or if the user's exercise rate is relatively high, then it may not be necessary or practical to present each of the images. Rather, some of the images may be skipped while still presenting the display programming at a rate that appears to the user like a video. For instance, rather than presenting a new image to the user each time the user has traveled the distance assigned to each image, a new image may be presented once the user has traveled two, three, four, or more times the assigned distance.

While the embodiments described herein have focused on relating the presentation of the display programming to the user's speed or the speed of a movable element on an exercise device, the present system may also correlate the presentation of the display programming to other exercise rates or parameters. For instance, the display programming may be correlated to a degree of incline or tilt of the exercise device. A higher incline may correlate to a shorter display duration, while a lower incline may correlate to a longer display duration, or vice versa. Likewise, the duration of the display programming may be based on a resistance setting on an exercise device. Still further, the display duration may be based on a physiological parameter of the user, such as heart rate, calorie burn, oxygen level, temperature, and the like.

What is claimed is:

1. An exercise system, comprising:

a movable element that is movable in the performance of an exercise, the movable element having at least one selectively adjustable operating parameter that selectively alters an exercise rate of a user relative to a default exercise rate; and a display that presents display programming to the user, the display programming comprising a plurality of consecutive frames, the display programming having a default display rate that corresponds to the default exercise rate, the display programming being adjustable to correlate the display programming with the exercise rate of the user, the display programming being adjusted by an amount that is commensurate with a difference between the exercise rate of the user and the default exercise rate by periodically pausing the display programming when the exercise rate of the user is less than the default exercise rate and greater than zero to correlate the display programming with the exercise rate of the user;

wherein the periodic pausing of the display programming includes presenting at least one frame at the default display rate between a first paused frame and a second paused frame within the plurality of consecutive frames when the exercise rate of the user is maintained at a rate that is greater than zero and less than the default exercise rate.

2. The exercise system of claim 1, wherein the display programming is adjusted by an amount that is commensurate with the difference between the exercise rate of the user and the default exercise rate.

3. The exercise system of claim 1, wherein the display programming is adjusted by pausing the display programming at regular intervals when the exercise rate of the user is less than the default exercise rate.

4. The exercise system of claim 1, wherein the durations of the periodic pauses in the display programming are substantially equal to one another.

5. The exercise system of claim 1, wherein the display programming is adjusted by pausing the display programming at irregular intervals when the exercise rate of the user is less than the default exercise rate.

6. The exercise system of claim 1, wherein the durations of the periodic pauses in the display programming are not all equal to one another.

7. The exercise system of claim 1, wherein periodically pausing the display programming increases the duration of display programming.

8. The exercise system of claim 1, wherein the exercise rate of the user is determined by at least one of the user's speed, the speed of the movable element, a resistance applied to the movable element, a degree of incline of the movable element, and a degree of tilt of the movable element.

9. The exercise system of claim 1, wherein the display programming is also adjusted by periodically skipping one or more frames of the display programming.

10. The exercise system of claim 9, wherein the periodically skipping one or more frames of the display programming decreases the duration of the display programming.

11. The exercise system of claim 9, wherein the display programming is adjusted by skipping one or more frames of the display programming when the exercise rate of the user is greater than the default exercise rate.

12. The exercise system of claim 9, wherein the display programming is adjusted by skipping one or more frames of the display programming at regular intervals when the exercise rate of the user is greater than the default exercise rate.

13. The exercise system of claim 9, wherein the display programming is adjusted by skipping one or more frames of the display programming at irregular intervals when the exercise rate of the user is greater than the default exercise rate.

14. An exercise system, comprising:

a movable element that is movable in the performance of an exercise, the movable element having at least one selectively adjustable operating parameter that selectively alters an exercise rate of a user relative to a default exercise rate; and a display that presents display programming to the user, the display programming having a duration that is adjustable to correlate the presentation of the display programming with the exercise rate of the user, wherein the system adjusts the duration of the display programming to correlate the display programming with the exercise rate of the user by:

periodically pausing the display programming when the user is exercising at an exercise rate greater than zero and the exercise rate of the user is less than the default exercise rate to correlate the display programming with the exercise rate of the user while the user is exercising, wherein the periodic pausing of the display programming includes presenting at least one frame at a default display rate between a first paused frame and a second paused frame within the display programming when the exercise rate of the user is maintained at a rate that is greater than zero and less than the default exercise rate; and periodically skipping one or more frames of the display programming when the exercise rate of the user is greater than the default exercise rate.

15. The exercise system of claim 14, wherein the periodic pausing of the display programming and the periodic skipping of one or more frames are done at generally regular intervals when the exercise rate of the user is less than or greater than the default exercise rate.

* * * * *